US005403378A

United States Patent [19]

Wells et al.

[11] Patent Number: 5,403,378

[45] Date of Patent: Apr. 4, 1995

[54] METHOD AND APPARATUS FOR PROTECTING AN INJECTION DEVICE DISPOSED IN A HOT BLAST CONDUIT OF A BLAST FURNACE

[75] Inventors: William Wells, Aylesbeare/Exeter, Great Britain; Ralph Weber, Rio de Janeiro, Brazil

[73] Assignee: Kortec AG, Zug, Switzerland

[21] Appl. No.: 84,412

[22] Filed: Jun. 29, 1993

[51] Int. Cl.[6] ..... C21B 7/16

[52] U.S. Cl. ..... 75/460; 266/46; 266/189; 266/270; 75/465

[58] Field of Search ..... 75/460, 461, 465; 266/189, 270, 222, 268

[56] References Cited

U.S. PATENT DOCUMENTS 1,518,854 12/1924 Kirby .
4,700,930 10/1987 de Lassat de Pressigny et al. ..... 75/460
4,887,800 12/1989 Hotta et al. ..... 266/189
5,018,458 5/1991 McIntyre et al. ..... 110/346

FOREIGN PATENT DOCUMENTS 532624 12/1976 U.S.S.R. .
91/14791 10/1991 WIPO .

OTHER PUBLICATIONS

"Investigation Pulverized Coal Injection with Oxygen at NKK", Steel Times, Feb. 1990, pp. 83-865.

*Primary Examiner*—Melvyn J. Andrews
*Attorney, Agent, or Firm*—Lahive & Cockfield

[57] ABSTRACT

To prevent burn-back at a coal dust injection lance which projects into a hot blast conduit of a blast furnace, cooling is effected using atomized coolant. Water is preferred as the coolant. The carrier gas used for the atomized water is either air or the oxygen which is injected through the lance for complete combustion of the coal dust.

11 Claims, 3 Drawing Sheets

METHOD AND APPARATUS FOR PROTECTING AN INJECTION DEVICE DISPOSED IN A HOT BLAST CONDUIT OF A BLAST FURNACE

BACKGROUND OF THE INVENTION

The invention concerns a method and an apparatus for protecting an injection device in a blast furnace. Specifically, the invention is directed to a method and apparatus for cooling the injection lance disposed in the hot blast conduit.

Injection lances for injection coal dust as a substitute fuel, for example for piece coke and heating oil, into the hot blast conduit of a blast furnace by means of a carrier gas, have long been used in the smelting of iron ores (Stahl und Eisen 110, 1990, pages 35–40). In recent times endeavours have been made to increase the maximum amounts of coal dust which hitherto could be injected by the injection of oxygen or an oxygen-bearing gas together with the coal dust which is entrained by a carrier gas.

In conjunction with the hot blast temperature which is about 1200° C., that results in a strong tendency to burn back in the mouth region of the injection lance.

U.S. Pat. No. 3,758,090 discloses an arrangement with which an injection lance for injecting fuel, which is fitted into the hot blast conduit of a blast furnace, can be cooled. The known injection lance comprises a central tube which serves for the supply of heating oil. The central tube is concentrically surrounded by a multi-wall outer tube in which oxygen is supplied; the oxygen serves for atomisation and combustion of the heating oil which issues from the central tube. For cooling purposes, the outer tube has a coolant duct which permits a circulation of coolant in the outer tube, by way of a feed connection and a discharge connection.

The object of the present invention is that of providing a method and an apparatus which provides improved cooling of the injection lance, which reduces the burn-back phenomenon.

SUMMARY OF THE INVENTION

In a two-tube lance, the coal dust is injected through the central duct and a mixture of oxygen-bearing gas and the cooling fluid is injected through an annular duct which surrounds the central duct.

In a three-tube lance, coal dust is injected through the central duct, oxygen-bearing gas is injected through the inner annular duct and the cooling fluid is injected through the outer annular duct. This permits mutually independent control of the pressures of the oxygen-bearing gas and the cooling fluid.

It is found to be particularly advantageous if the cooling fluid used is water which is injected in the form of a spray mist in an atomised condition, by means of a carrier gas. As a result of atomisation of the water, microdrops are formed, which are at least partly in contact with the tube wall to be cooled and which by virtue of their enthalpy of evaporation, make a particularly effective contribution to the overall cooling action which in other respects is achieved by a transfer of heat from the tube wall to the cooling fluid which is formed from the water and the carrier gas and which flows past the tube wall.

Further advantageous configurations of the injection are set forth in the description that follows.

BRIEF DESCRIPTION OF THE DRAWINGS

The preferred embodiments of the invention are described in greater detail with reference to the accompanying drawings in which.

DETAILED DESCRIPTION

Figure 1:
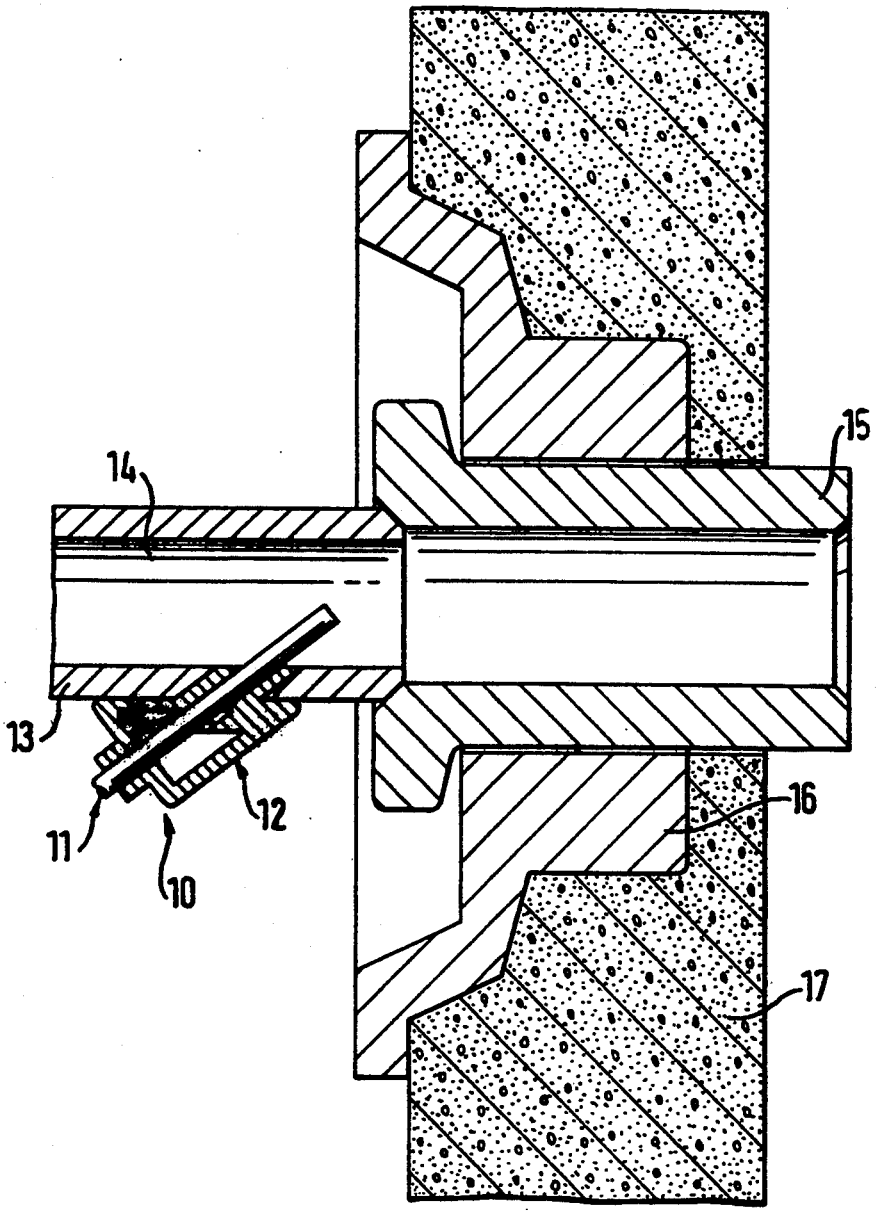
FIG. 1 shows an injection apparatus according to the invention, which is fitted into a hot blast conduit of a blast furnace.

FIG. 1 shows an injection apparatus 10 comprising an injection lance 11 and a receiving arrangement 12 for accommodating the injection lance 11 in an outside wall 13 of a hot blast conduit 14.

The hot blast conduit 14 serves for feeding hot air at about 1200° C. into the interior of a blast furnace (not shown here). The hot blast conduit 14 opens into a water-cooled tuyere 15 which is accommodated by a water-cooled tuyere insert 16. The tuyere insert 16 is fitted into a wall 17 of the blast furnace.

The injection apparatus 10 serves for the injection of coal dust into the hot blast conduit 14 of the blast furnace. The coal dust which issues from the injection lance 11 into the hot blast is heated by the hot blast and is ignited at the latest upon passing into the blast furnace.

Figure 3:
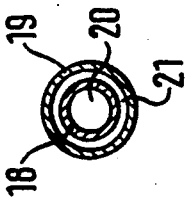
FIG. 3 is a view of the injection lance of FIG. 2 in cross-section taken along section line III—III in FIG. 2.
Figure 2:
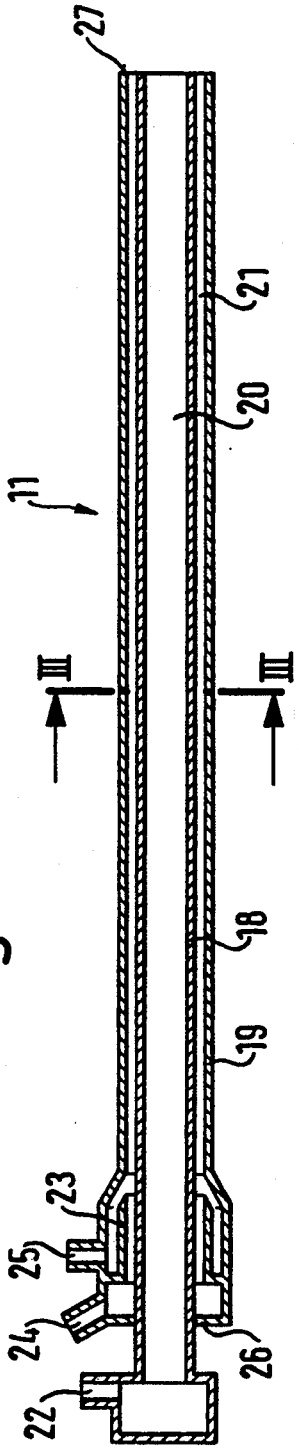
FIG. 2 is a view in longitudinal section of an injection lance of an injection apparatus which is fitted into a hot blast conduit of a blast furnace, as shown in FIG. 1.

FIGS. 2 and 3 show a first embodiment of the injection lance 11. It comprises a central inner tube 18 and an outer tube 19 which is arranged in concentric relationship with the inner tube 18. The inner tube 18 forms a central duct 20 and the outer tube 19, by virtue of its radial spacing relative to the inner tube 18, forms an annular duct 21 (see FIG. 3). The inner tube 18 is provided with an inlet 22 for the supply of a mixture comprising a carrier gas and coal dust. The outer tube 19 has two inlets 24 and 25 which are separated from each other by a separating wall or partition 23. The inlet 24 which is towards a closed end 26 of the tube serves for the supply of water and the adjacent inlet 25 serves for the supply of oxygen.

The injection lance 11 shown in FIGS. 2 and 3 can be used for carrying out the per se known method of injecting coal dust through the central inner tube 18 by means of a carrier gas and supplying oxygen through the annular duct 21 for better combustion of the coal dust.

Now, in accordance with the method of the invention, water is added through the inlet 24 to the oxygen which is carried in the annular duct 21 so that the water is entrained by the oxygen which flows past the separating wall 23 and is atomised, forming fine microdrops. The spray mist of oxygen and water which is formed in that way serves both for combustion of the coal dust issuing from the duct 20 and also for cooling of the walls of the inner tube 18 and the outer tube 19 including the discharge cross-section 27 of the injection lance 11, which, as shown in FIG. 1, is exposed to the hot blast flow in the hot blast conduit 14.

In the described variant of the method according to the invention therefore, the oxygen serves not only for better combustion of the coal dust but also as a carrier gas for the atomised water.

Figure 5:
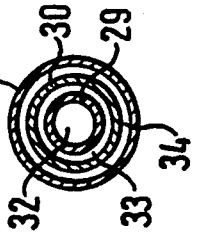
FIG. 5 is a view of the injection lance shown in FIG. 4 in cross-section taken along section line V—V in FIG. 4.
Figure 4:
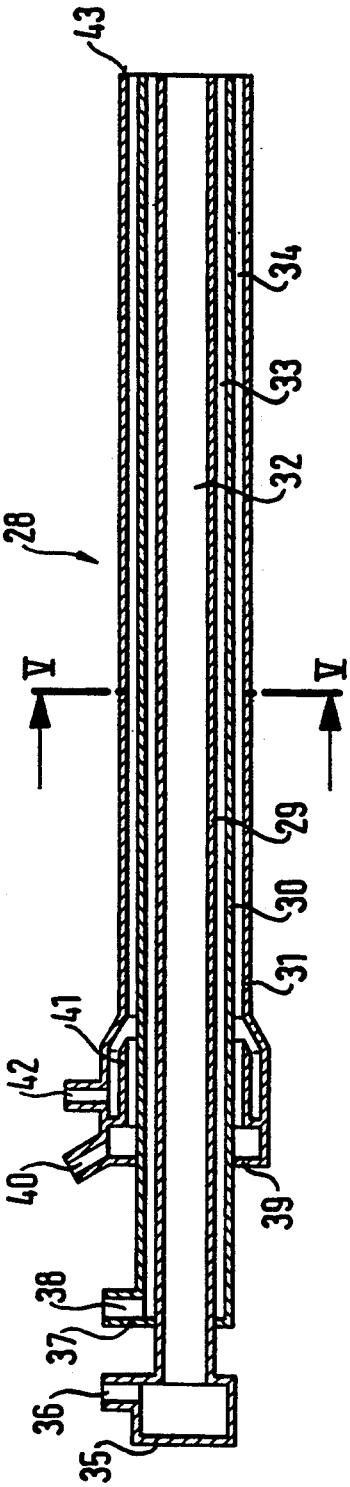
FIG. 4 is a view in longitudinal section of a further embodiment of an injection lance.

FIGS. 4 and 5 show an injection lance for carrying out a further alternative form of the method according to the invention. The injection lance 28 comprises a central inner tube 29, a central tube 30 and an outer tube 31. The inner tube 29 and the central tube 30 as well as the outer tube 31 are concentric and arranged with radially spaced-apart tube walls. The inner tube 29 forms a central duct 32; the inner tube 29 and the central tube 30 form an inner annular duct 33; and the central tube 30 and the outer tube 31 form an outer annular duct 34. At its closed tube end 35 the inner tube 29 has an inlet 36 for supplying a mixture comprising a carrier gas and coal dust. In the region of its closed end 37 the central tube 30 has an inlet 38 for the supply of oxygen. Finally in the region of its closed end 39 the outer tube 31 has an inlet 40 which is disposed directly at the end of the tube, for the supply of water, and an inlet 42 which is adjacent thereto and which is separated by a separating wall 41, for the supply of air as the carrier gas.

With that injection lance, coal dust, suspended in a carrier gas, is injected through the central duct 32, oxygen is injected through the inner annular duct 33 and a spray mist comprising water with air as the carrier gas is injected through the outer annular duct 34.

The separate supply of the cooling fluid and the oxygen permits mutually independent control of the amounts of those agents which are discharged.

Figure 6:
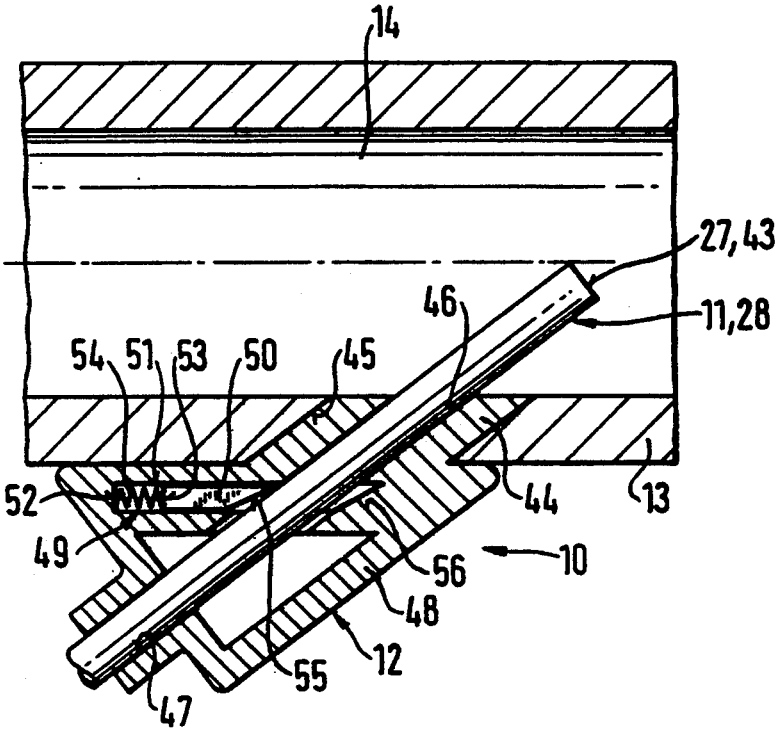
FIG. 6 shows an injection apparatus fitted into the hot blast conduit of a blast furnace as shown in FIG. 1, with an injection lance accommodated in a receiving arrangement.

FIG. 6 shows the injection apparatus 10 with the receiving arrangement 12 for receiving the injection lance 11 and 28 respectively.

The receiving arrangement 12 has a connecting region 44 with which it is fitted into a connecting opening 45 in the outside wall 13 of the hot blast conduit 14. The injection lance 11 or 28 respectively can be inserted in its longitudinal direction into the receiving arrangement 12 and is held in the inserted condition in two receiving bores 46, 47 in the receiving arrangement 12. In that connection, the injection lance 11, 28 is oriented at an acute angle relative to the hot blast flow in the hot blast conduit 14. In that arrangement, the discharge opening 27, 43 of the injection lance 11, 28 is disposed approximately in the region of the centre line of the hot blast flow.

Adjoining the connecting region 44 of the receiving arrangement 12 is a housing portion 48 which is adapted to the contour of the outside wall 13 of the hot blast conduit 14. The housing portion 48 has a closure means 49 which provides for automatic closure of the receiving bore 46 after removal of the injection lance 11, 28 from the receiving arrangement 12.

The closure means 49 comprises a cover-like closing member 50 which is displaceably guided in a guide groove 51 substantially parallel to the outside wall 13 of the hot blast conduit 14. A compression spring 54 is disposed between the groove bottom which is formed as an abutment 52, and an end region 53, which is towards the abutment 52, of the closing member 50. The end region of the closing member 50, which is arranged in opposite relationship to the end region 53 of the closing member 50, is in the form of a closing edge 55. As viewed in the direction of displacement of the closing member 50, arranged in the housing portion 48 is a closing means 56 which is of a configuration which corresponds to the closing edge 55.

FIG. 6 shows the closing means 49 in the open condition, the closing edge 55 of the closing member 50 being separated from the closing recess 56 by the injection lance 11, 28. In that condition the closing member 50 bears under a spring loading against the side of the injection lance 11, 28. After removal of the injection lance 11, 28 from the receiving arrangement 12, the closing member 50 is displaced by virtue of the force applied thereto by the compression spring 54, until the closing edge 55 bears in position in the closing recess 56, whereby the receiving bore 46 of the receiving arrangement 12 is closed and any discharge of gases from the hot blast conduit 14 is prevented.

For the purposes of opening the closure means 49, the injection lance 11, 28 is pushed with its discharge openings 27, 43 against the closing edge 55 of the closing member 50 so that, by utilising the wedge effect, as the closing edge 55 and the longitudinal wall of the injection lance 11, 28 are disposed at an acute angle to each other, the closing member 50 is displaced towards the abutment 52 against the force of the compression spring 54 and the injection lance 11, 28 can be moved into a position in which it is ready for operation, in the receiving arrangement 12.

What is claimed is:

1. A method of cooling an injection lance having a discharge end which extends into a hot blast conduit furnace comprising the steps of providing said injection lance with at least two tubes, which are concentrically arranged and radially spaced from each other to form a central duct and a first annular duct, each of said tubes being open at said discharge end for injecting material into said hot blast conduit, injecting a fine grain solid fuel into said hot blast conduit through a first one of said tubes, and injecting a cooling means, through another of said tubes, for the evaporative cooling of said first one of said tubes.

2. A method according to claim 1, wherein said fine grain solid is injected through said central duct, and said injecting of a cooling means includes injecting a spray mist of water through said first annular duct.

3. A method according to claim 1 including the step of providing said injection lance with a third tube open at said discharge end for injecting a material into said hot blast conduit, and concentrically arranged with and radially spaced from said other two tubes to thereby form a second annular duct having an annular shape and surrounding said central duct and said first annular duct.

4. A method according to claim 3, wherein said fuel is injected through said first duct, an oxygen-bearing gas is injected through said second duct, and said cooling means is injected through said third duct.

5. A method according to claim 1 wherein said injecting of fine grain solid fuel includes mixing an oxygen-bearing gas with a fine grain solid fuel.

6. A method according to claim 1, wherein said fine grain solid fuel includes coal dust.

7. An injection apparatus having a discharge end which extends into a hot blast conduit of a blast furnace comprising at least two tubes which are concentrically arranged and radially spaced from each other to form a central duct and a first annular duct, each of said tubes being open at said discharge end for injecting material into said hot blast conduit, a first one of said tubes for injecting a fine grain solid fuel into said hot blast conduit, and another of said tubes for injecting a cooling means for the evaporative cooling of said first one of said tubes.

8. An injection apparatus according to claim 7 wherein said tubes are removably inserted through an opening in a wall of said hot blast conduit, and further comprising attachment means for attaching said injection apparatus to an outside portion of said wall of said hot blast conduit, and said attachment means comprises closing means for automatically closing said opening in said wall of said hot blast conduit upon removal of said tube means.

9. An injection apparatus according to claim 7, wherein said fuel is injected through said central duct, and said cooling means is a spray mist of water injected through said first annular duct.

10. An injection apparatus according to claim 7, further comprising a third tube open at said discharge end for injecting material into said hot blast conduit, and being concentrically arranged with and radially spaced from said other tube tubes to thereby form a second annular duct having an annular shape and surrounding said central duct and said first annular duct.

11. An injection apparatus according to claim 7, wherein said fuel is injected through said central duct, an oxygen-bearing gas is injected through said first annular duct, and said cooling means is a spray mist of water injected through said second annular duct.

* * * * *

UNITED STATES PATENT AND TRADEMARK OFFICE

CERTIFICATE OF CORRECTION

PATENT NO. : 5,403,378
DATED : April 4, 1995
INVENTOR(S) : William Wells and Ralph Weber It is certified that error appears in the above-indentified patent and that said Letters Patent is hereby corrected as shown below:

On the title page, Item [63], Foreign Application Data

Nov. 4, 1991 [DE] Germany.....P4136274.8 -

Signed and Sealed this

Eighteenth Day of June, 1996

*Attest:*

BRUCE LEHMAN

*Attesting Officer*

*Commissioner of Patents and Trademarks*